US007390212B1

(12) United States Patent
Yang

(10) Patent No.: US 7,390,212 B1
(45) Date of Patent: Jun. 24, 2008

(54) STRUCTURE FOR FIXING LIGHT GUIDE ELEMENT TO AN ELECTRIC CONNECTOR

(75) Inventor: Haven Yang, Taipei (TW)

(73) Assignee: All Best Electronics Co., Ltd., Taipei (TW)

( * ) Notice: Subject to any disclaimer, the term of this patent is extended or adjusted under 35 U.S.C. 154(b) by 0 days.

(21) Appl. No.: 11/866,539

(22) Filed: Oct. 3, 2007

(51) Int. Cl.
*H01R 3/00* (2006.01)

(52) U.S. Cl. ..... 439/490; 439/608

(58) Field of Classification Search ..... 385/135; 439/490, 893, 901, 920, 949, 541.5; 361/702–704, 361/709–710, 715, 717, 719
See application file for complete search history.

(56) References Cited

U.S. PATENT DOCUMENTS 5,876,239 A * 3/1999 Morin et al. ..... 439/490
6,174,194 B1 * 1/2001 Bleicher et al. ..... 439/490
6,352,446 B2 * 3/2002 Ezawa et al. ..... 439/490
7,175,327 B1 * 2/2007 Tsai ..... 362/555
7,249,966 B2 * 7/2007 Long ..... 439/541.5
2007/0253168 A1 * 11/2007 Miller ..... 361/719

* cited by examiner

*Primary Examiner*—Michael C Zarroli
(74) *Attorney, Agent, or Firm*—Apex Juris, pllc; Tracy M Heims

(57) ABSTRACT

A structure for fixing light guide element to an electric connector includes a connector case internally defining at least one socket, and externally provided on a top surface with at least one locating plate above the socket, at least one hold-down tab behind the locating plate, and at least one elastic stopper behind the hold-down tab; and a light guide element consisting of a plurality of parallelly arranged light guide units interconnected via a transverse bridge section having at least one slit formed on a front side thereof. When the straight front end section of each light guide unit is forward extended through a corresponding locating plate, the elastic stopper would abut on a rear side of the bridge section, and the slit on the bridge section would engage with the hold-down tab, enabling the light guide element to be flatly assembled to the top surface of the connector case.

14 Claims, 6 Drawing Sheets

STRUCTURE FOR FIXING LIGHT GUIDE ELEMENT TO AN ELECTRIC CONNECTOR

FIELD OF THE INVENTION

The present invention relates to a structure for fixing light guide element to an electric connector, and more particularly to a light guide element fixing structure that has simple structure to enable reduced production cost, and provides firm connection of a light guide element to an electric connector.

BACKGROUND OF THE INVENTION

Electric connectors provided with indicating lamps have been widely known and are often employed on many modular sockets or other similar electric devices. The modular sockets are mounted on a circuit board for a corresponding modular plug to insert thereinto to enable an electric connection thereat. In a conventional electric connector with an indicating lamp, a light emitting diode (LED) is embedded in a front side of a case for the electric connector, so that light emitted from the LED is used to indicate an operational or functional state of the electric connector, such as, for example, the receiving or transmitting of data or signals, the normal connection of different parts in an apparatus, the on or off of a power supply, an abnormal condition in data transmission over a network, etc. However, with the tendency of miniaturization, there is no longer sufficient space in the connector cases of miniaturized electronic and telecommunication products for mounting an LED therein, which inevitably causes confusions in product design.

FIGS. 1 to 3 illustrate a conventional structure for fixing a light guide element to an electric connector. As shown, the structure mainly includes a connector case 3, a holding bracket 4, and a light guide element 20.

The connector case 3 is provided at lower edges with a plurality of downward projected insertion tabs 31 for inserting into holes correspondingly formed on a circuit board to serve as locating and grounding means. The connector case 3 is also provided at a front side with a plurality of sockets 32, into which a correspondingly formed plug may be plugged to enable an electric connection thereat. A plurality of raised strips 33 are formed on a top surface of the connector case 3 above each of the sockets 32 to extend in a direction parallel to an extension direction of the socket 32, so that a guide path 331 is formed between any two adjacent raised strips 33 on each socket 32. The connector case 3 is also externally provided on each of two lateral surfaces with a plurality of hooks 34.

The holding bracket 4 has a front side being bent to form a raised end portion 43. The raised end portion 43 is formed at an outer edge with a plural set of notches 431 corresponding to the guide paths 331 on the connector case 3, and on a top thereof with a plural set of channels 42 corresponding to and extended rearward from the notches 431. At least one set of two longitudinally spaced clamping plates 45 are formed on the holding bracket 4 near a middle portion thereof behind the raised end portion 43. The holding bracket 4 is also provided at each of two lateral sides with a plurality of downward bent vertical sections 44 and a plurality of upward bent vertical sections 41. Each of the downward bent vertical sections 44 has a retaining hole 441 formed thereon corresponding to the hooks 34 on the connector case 3. Through engagement of the retaining holes 441 with the hooks 34, the holding bracket 4 may be fixed to the top surface of the connector case 3.

The light guide element 20 consists of a plurality of parallelly arranged light guide units 21 interconnected with one another via a transversely extended bridge section 22. Each of the light guide units 21 is of L-shaped to have a straight front portion defining an upper end section 211 and a downward bent rear portion defining a lower end section 212. The bridge section 22 is provided at each of two lateral sides thereof with a sideward opened recess 203 corresponding to the upward bent vertical sections 41 on the holding bracket 4. Each of the lower end sections 212 is provided at one side thereof with a downward projected insertion section 24.

The light guide element 20 is assembled to the top surface and a rear outer side of the connector case 3 via the holding bracket 4 by extending the upper end sections 211 of the light guide element 20 into the channels 42 on the holding bracket 4 to forward project from the notches 431, locating the bridge section 22 between the set of two longitudinally spaced clamping plates 45 with the upward bent vertical sections 41 at two lateral sides of the holding bracket 4 separately abutting on the two sideward opened recesses 203 at two lateral sides of the bridge section 22, and inserting the downward projected insertion sections 24 at the lower end sections 212 into the circuit board (not shown).

With the above structure, the light guide element 20 is fixed to an outside of the connector case 3 to enable effective reduction of the volume of the connector case 3. However, the light guide element 20 is fixed to the connector case 3 via the holding bracket 4, which inevitably complicates the assembling of the electric connector and increases the component cost of the electric connector to disadvantageously lower the competitive ability of a finished product of the electric connector in the market.

It is therefore tried by the inventor to develop a simplified structure for fixing a light guide element to an electric connector to eliminate the drawbacks in the conventional electric connector having a light source provided therewith.

SUMMARY OF THE INVENTION

A primary object of the present invention is to provide a simplified structure for fixing light guide element to an electric connector, so as to effectively reduce the material cost for the electric connector.

Another object of the present invention is to provide a simplified structure for fixing light guide element to an electric connector, so as to effectively reduce the assembling procedures and cost for the electric connector.

To achieve the above and other objects, the structure for fixing light guide element to an electric connector according to the present invention includes a connector case internally defining at least one socket for a correspondingly formed plug to insert thereinto to enable an electrical connection thereat, and being externally provided on a top surface with at least one transversely extended upright and holed locating plate corresponding to the at least socket, and behind the at least one locating plate with at least one transversely extended elastic stopper; and a light guide element consisting of a plurality of parallelly arranged light guide units, which are interconnected with one another via a transverse bridge section. Each of the light guide units has a straight front portion defining an upper end section and a downward bent rear portion defining a lower end section. When the upper end section is forward extended through and held to the at least one locating plate on the top surface of connector case, and the at least one elastic stopper is abutted on a rear side of the bridge section, the whole light guide element is flatly assembled to the top surface of the connector case.

The bridge section of the light guide element is provided on a front side with at least one slit, and the connector case is externally provided on the top surface with at least one hold-down tab corresponding to the slit formed on the bridge section, such that the slit is engaged with the hold-down tab when the light guide element is assembled to the top surface of the connector case.

The connector case is externally provided on the top surface above the at least one socket with a plurality of raised strips extended in a direction parallel to an extension direction of the socket, so that a guide path is formed between any two adjacent ones of the raised strips on the socket for receiving the upper end section of the light guide unit that is forward extended through the locating plate.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 4:
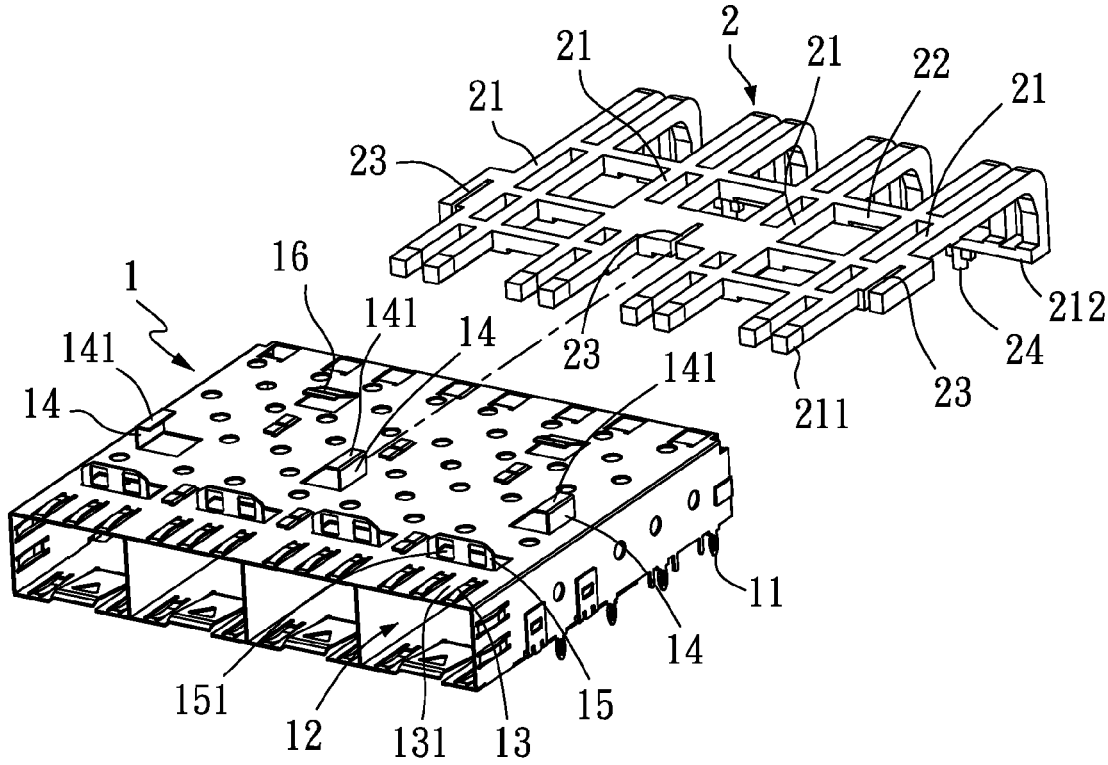
FIG. 4 is an exploded perspective view of a structure for fixing light guide element to an electric connector according to a first embodiment of the present invention.

Please refer to FIG. 4 that is an exploded perspective view of a structure for fixing light guide element to an electric connector according to a first embodiment of the present invention. For the purpose of conciseness, the structure of the present invention is also briefly referred to as the "fixing structure" herein. As shown, the fixing structure according to a first embodiment of the present invention as shown in FIG. 4 includes a connector case 1 and a light guide element 2.

The connector case 1 is provided at and along lower edges with a plurality of downward projected insertion tabs 11 for inserting into holes correspondingly formed on a circuit board (not shown) to serve as locating and grounding means. The connector case 1 is also provided on at least one side, which is the front side in the illustrated embodiment, with at least one socket 12, into which a correspondingly formed plug may be plugged to enable an electrical connection thereat. There are four sockets 12 shown in the illustrated first embodiment. A plurality of raised strips 13 are formed on a top surface of the connector case 1 above each of the sockets 12 to extend in a direction parallel to an extension direction of the socket 12, so that a guide path 131 is formed between any two adjacent raised strips 13 on the socket 12. At least one upward extended hold-down tab 14 is formed on the top surface of the connector case 1 near a middle portion thereof. There are three hold-down tabs 14 shown in the illustrated first embodiment. Each of the hold-down tabs 14 is extended in a direction parallel with the extension direction of the sockets 12, and has a sideward bent upper end to provide a hook portion 141. On the top surface of the connector case 1, there are also transversely formed at least one upright locating plate 15 between the raised strips 13 and the hold-down tabs 14, and at least one elastic stopper 16 behind the hold-down tabs 14. In the illustrated first embodiment, there are shown four locating plates 15 corresponding to the four sockets 12, and two stoppers 16 located at predetermined positions. Each of the locating plates 15 has through holes 151 formed thereon corresponding to the guide paths 131 on each of the sockets 12.

The light guide element 2 consists of a plurality of light guide units 21 (four are shown in the illustrated first embodiment corresponding to the four sockets 12), which are parallelly arranged but transversely interconnected with one another by a transverse bridge section 22. Each of the light guide units 21 has a straight front portion to define an upper end section 211 configured corresponding to the through holes 151 formed on each of the locating plates 15, and a downward bent rear portion to define a lower end section 212. The bridge section 22 is provided on a front side at positions corresponding to the hold-down tabs 14 with a slit 23 each. Each of the slits 23 has an open end being directed in the same direction as the upper end sections 211 of the light guide units 21. A plurality of downward projected insertion sections 24 are separately provided below the lower end sections 212 for inserting into holes correspondingly formed on the circuit board.

Figure 1:
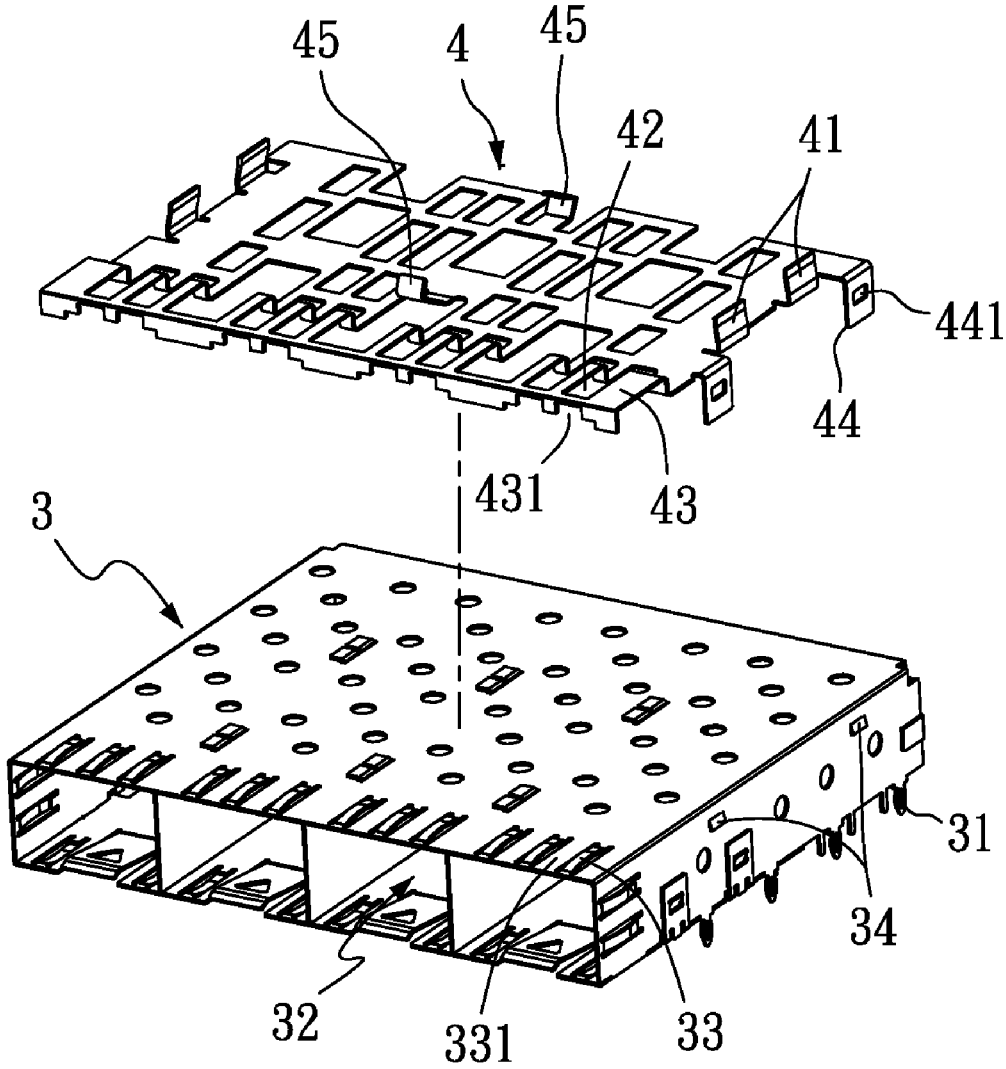
(PRIOR ART) Fig. 1
FIG. 1 is an exploded perspective view showing part of a conventional structure for fixing a light guide element to an electric connector.
Figure 2:
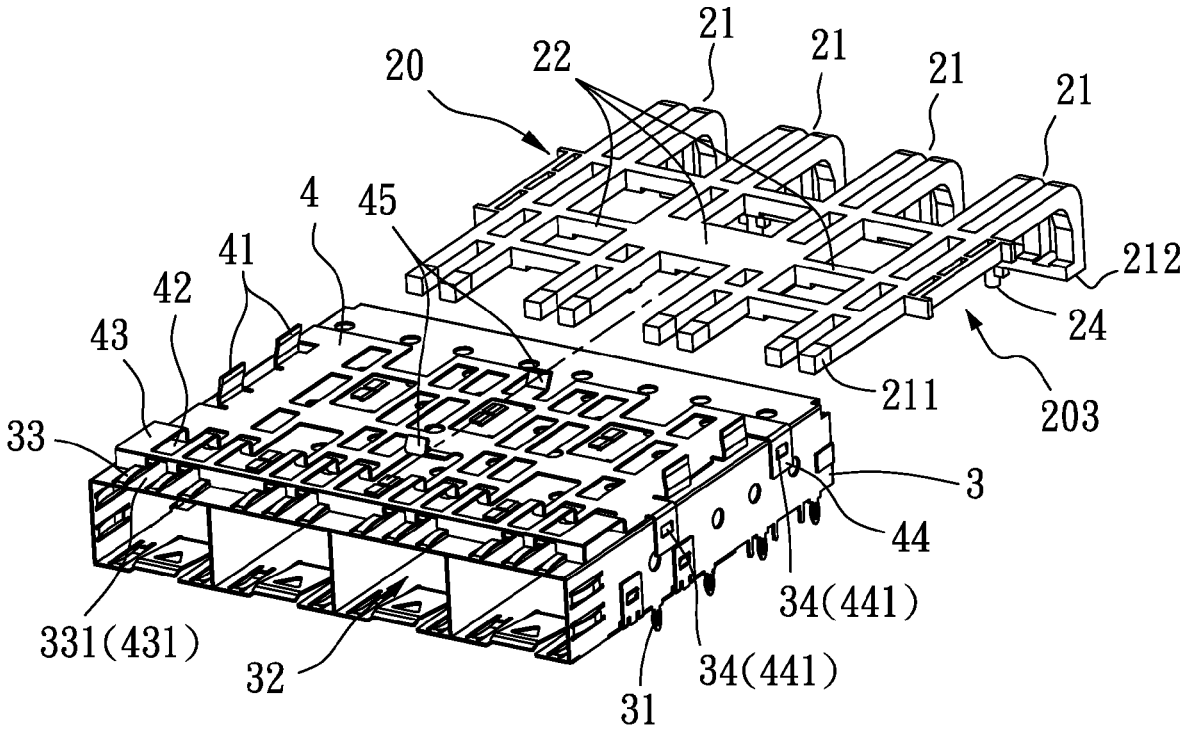
(PRIOR ART) Fig. 2
FIG. 2 is an assembled view of FIG. 1 with a light guide element to be assembled thereto.
Figure 3:
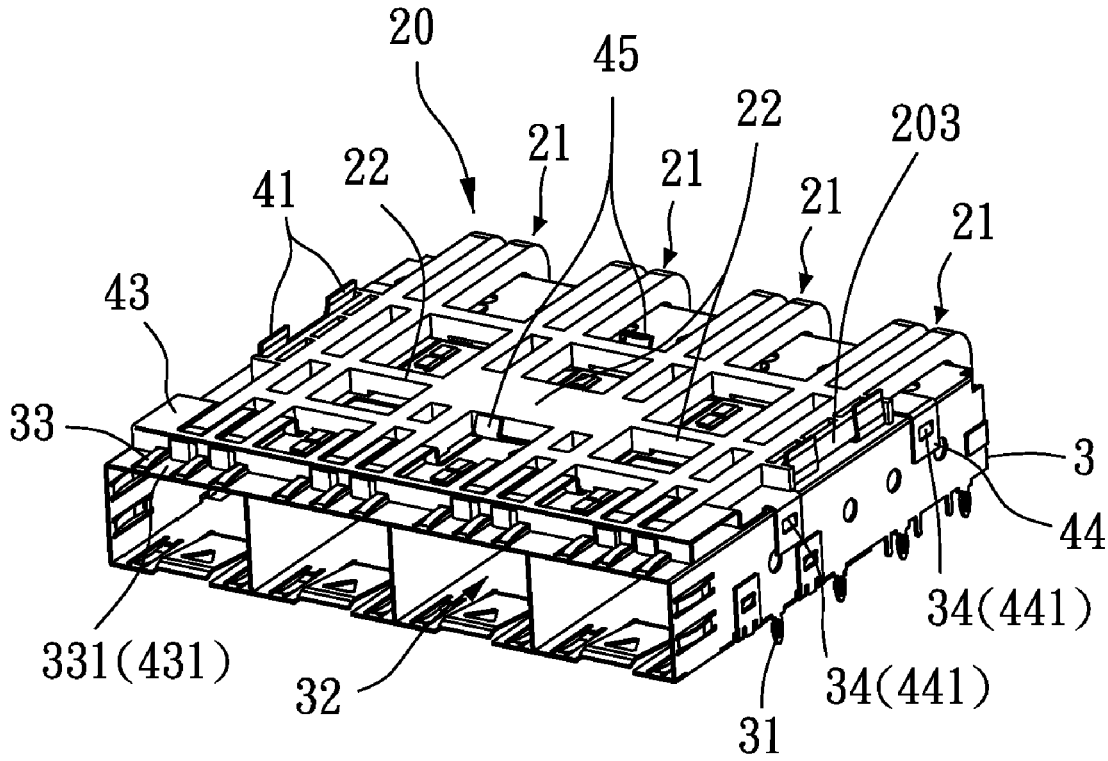
(PRIOR ART) Fig. 3
FIG. 3 is a fully assembled view of FIG. 2.
Figure 5:
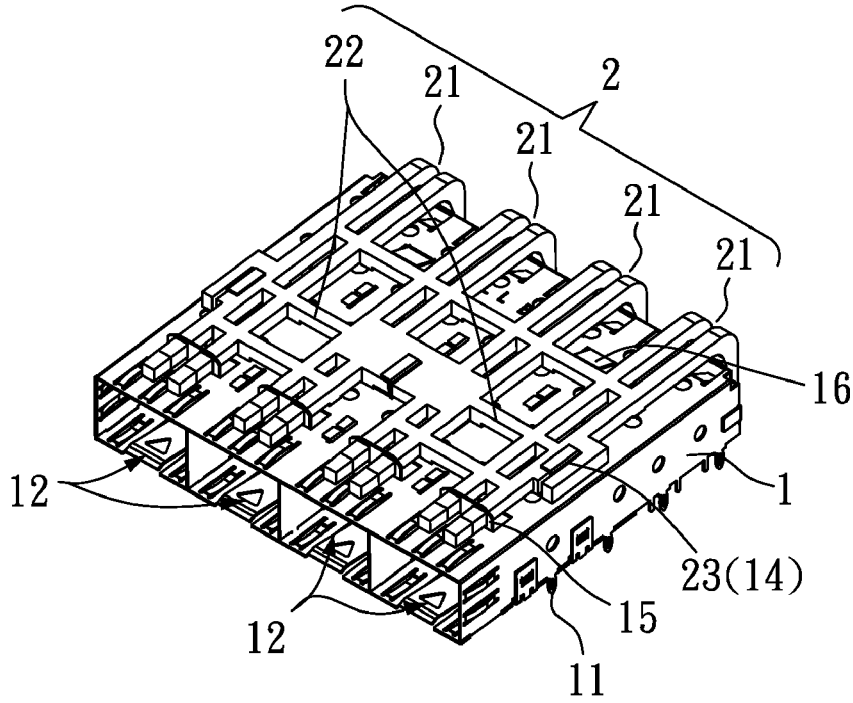
FIG. 5 is an assembled view of FIG. 4.
Figure 6:
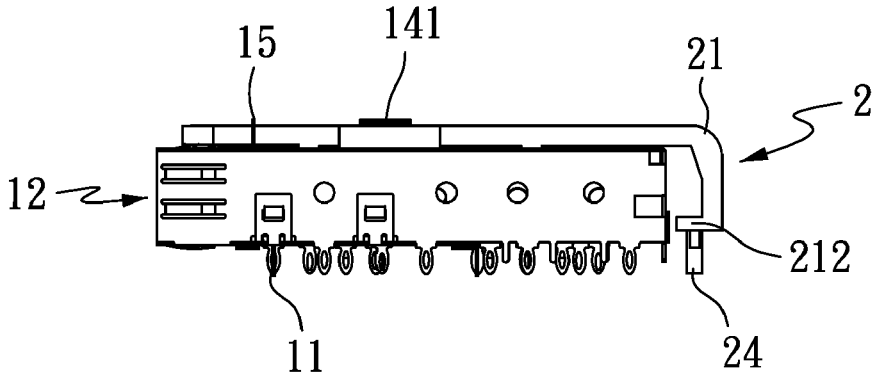
FIG. 6 is a side view of FIG. 5.

The light guide element 2 is externally assembled to the top surface of the connector case 1 by engaging the slits 23 with the hold-down tabs 14 on the connector case 1, such that the hook portions 141 of the hold-down tabs 14 are abutted on a top of the bridge section 22. At this point, the upper end sections 211 of the light guide units 21 are separately extended through the through holes 151 on the locating plates 15 into corresponding guide paths 131; and the lower end sections 212 of the light guide units 21 are located behind a rear side of the connector case 1 with the insertion sections 24 inserted in holes correspondingly formed on the circuit board. Meanwhile, the elastic stoppers 16 are located behind the bridge section 22 to bear against a rear side of the bridge section 22. In this manner, the light guide units 21 of the whole light guide element 2 are flatly held to the top surface of the connector case 1, as shown in FIGS. 5 and 6. The fixing structure of the present invention may be produced with effectively reduced material and simplified fabricating procedures to lower the production cost thereof, compared to the conventional fixing structure as shown in FIGS. 1, 2, and 3.

Figure 7:
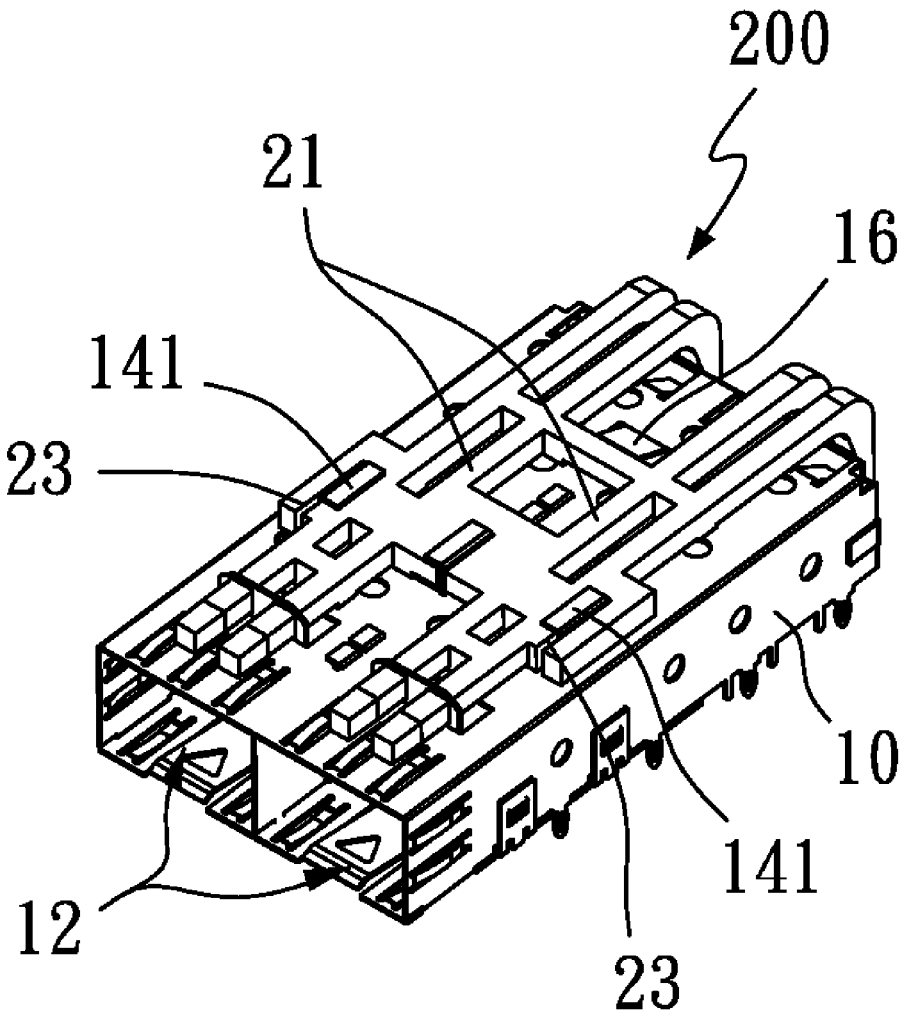
FIG. 7 is an assembled perspective view of a structure for fixing light guide element to an electric connector according to a second embodiment of the present invention.

FIG. 7 is an assembled perspective view of a structure for fixing light guide element to an electric connector according to a second embodiment of the present invention. The fixing structure in the second embodiment is generally denoted a reference numeral 200, and is structurally similar to the first embodiment, except for a connector case 10 having only two sockets 12 provided thereon, and a light guide element 200 consisting of only two light guide units 21.

What is claimed is:

1. A structure for fixing light guide element to an electric connector, comprising:

a connector case internally defining at least one socket for a correspondingly formed plug to insert thereinto to enable an electrical connection thereat; and being externally provided on a top surface with at least one locating plate corresponding to the at least socket, and at least one stopper located at a distance behind the at least one locating plate; and a light guide element consisting of a plurality of parallelly arranged light guide units, which are interconnected with one another via a transverse bridge section; each of the light guide units having a straight front portion defining an upper end section and a downward bent rear portion defining a lower end section;

whereby when each of the upper end sections is extended through and held to one corresponding locating plate on the top surface of connector case, the at least one stopper is abutted on a rear side of the bridge section, enabling the light guide units of the light guide element to be flatly assembled to the top surface of the connector case.

2. The fixing structure as claimed in claim 1, wherein the bridge section of the light guide element is provided on a front side with at least one slit, and the connector case is externally provided on the top surface with at least one upright hold-down tab corresponding to the slit formed on the bridge section, such that the slit is engaged with the hold-down tab when the light guide element is assembled to the top surface of the connector case.

3. The fixing structure as claimed in claim 2, wherein the hold-down tab has a sideward bent upper end to provide a hook portion, which is abutted on a top of the bridge section to one side of the slit when the light guide element is assembled to the top surface of the connector case.

4. The fixing structure as claimed in claim 2, wherein the hold-down plate is extended in a direction parallel with an extension direction of the at least one socket.

5. The fixing structure as claimed in claim 3, wherein the hold-down plate is extended in a direction parallel with an extension direction of the at least one socket.

6. The fixing structure as claimed in claim 1, wherein the connector case is externally provided on the top surface above the at least one socket with a plurality of raised strips extended in a direction parallel to an extension direction of the socket, so that a guide path is formed between any two adjacent ones of the raised strips.

7. The fixing structure as claimed in claim 2, wherein the connector case is externally provided on the top surface above the at least one socket with a plurality of raised strips extended in a direction parallel to an extension direction of the socket, so that a guide path is formed between any two adjacent ones of the raised strips.

8. The fixing structure as claimed in claim 3, wherein the connector case is externally provided on the top surface above the at least one socket with a plurality of raised strips extended in a direction parallel to an extension direction of the socket, so that a guide path is formed between any two adjacent ones of the raised strips.

9. The fixing structure as claimed in claim 1, wherein the light guide element includes at least one insertion section downward projected from each of the lower end sections of the light guide units for inserting into a circuit board.

10. The fixing structure as claimed in claim 2, wherein the light guide element includes at least one insertion section downward extended from each of the lower end sections of the light guide units for inserting into a circuit board.

11. The fixing structure as claimed in claim 3, wherein the light guide element includes at least one insertion section downward extended from each of the lower end sections of the light guide units for inserting into a circuit board.

12. The fixing structure as claimed in claim 1, wherein the at least one locating plate is provided with at least one through hole, via which the upper end section of each light guide unit of the light guide element is forward extended through the locating plate.

13. The fixing structure as claimed in claim 2, wherein the at least one locating plate is provided with at least one through hole, via which the upper end section of each light guide unit of the light guide element is forward extended through the locating plate.

14. The fixing structure as claimed in claim 3, wherein the at least one locating plate is provided with at least one through hole, via which the upper end section of each light guide unit of the light guide element is forward extended through the locating plate.

* * * * *